US009114971B2

(12) United States Patent
Rasmussen et al.

(10) Patent No.: US 9,114,971 B2
(45) Date of Patent: Aug. 25, 2015

(54) METHOD AND A SYSTEM FOR PRESSURISING AND DISPENSING FLUID PRODUCTS STORED IN A BOTTLE, CAN, CONTAINER OR SIMILAR DEVICE

(75) Inventors: Jan Norager Rasmussen, Olstykke (DK); Steen Vesborg, Gentofte (DK)

(73) Assignee: CARLSBERG BREWERIES A/S, Copenhagen V (DK)

( * ) Notice: Subject to any disclaimer, the term of this patent is extended or adjusted under 35 U.S.C. 154(b) by 7 days.

(21) Appl. No.: 13/264,674

(22) PCT Filed: Apr. 14, 2010

(86) PCT No.: PCT/EP2010/054878
§ 371 (c)(1), (2), (4) Date: Nov. 10, 2011

(87) PCT Pub. No.: WO2010/119056
PCT Pub. Date: Oct. 21, 2010

(65) Prior Publication Data

US 2012/0043352 A1 Feb. 23, 2012

(30) Foreign Application Priority Data

Apr. 15, 2009 (EP) ..... 09388011
Apr. 23, 2009 (EP) ..... 09388012

(51) Int. Cl.
*B67D 1/04* (2006.01)

(52) U.S. Cl.
CPC ..... *B67D 1/0412* (2013.01); *B67D 1/0443* (2013.01)

(58) Field of Classification Search
USPC ..... 222/386.5, 95, 105, 195
See application file for complete search history.

(56) References Cited

U.S. PATENT DOCUMENTS 3,023,750 A * 3/1962 Baron ..... 604/141
3,096,000 A * 7/1963 Staley ..... 222/1

(Continued)

FOREIGN PATENT DOCUMENTS

EP 1170247 1/2002
WO WO2007/108684 9/2007

(Continued)

OTHER PUBLICATIONS

International Search Report on related PCT application (PCT/EP2010/054878); International Searching Authority (EPO) dated May 11, 2010.

*Primary Examiner* — Paul R Durand
*Assistant Examiner* — Vishal Pancholi
(74) *Attorney, Agent, or Firm* — Klein, O'Neill & Singh, LLP

(57) ABSTRACT

A self regulating and constant pressure maintaining product dispenser assembly comprises a dispensing device and a product container defining an inner space comprising a product space being filled with a fluid product constituting a carbonated beverage, and a pressure space being filled with a propellant gas having an initial pressure of preferably 0.5-1.8 bar above the atmospheric pressure when subjected to a specific temperature range of preferably 3° C.-50° C. The pressure space further comprises an amount of an adsorption material having adsorbed an amount of the propellant gas, which is sufficient for allowing the pressure space to increase in volume and to substitute the product space. The particular amount of adsorption material is inherently capable of substantially maintaining the initial pressure in the pressure space by releasing the propellant gas into the pressure space and adsorbing the propellant gas from the pressure space.

10 Claims, 8 Drawing Sheets

(56) References Cited

U.S. PATENT DOCUMENTS

| | | | | | |
|---|---|---|---|---|---|
| 3,613,954 | A | * | 10/1971 | Bayne | 222/61 |
| 3,858,764 | A | * | 1/1975 | Watson | 222/399 |
| 3,964,649 | A | * | 6/1976 | Alexander | 222/399 |
| 4,049,158 | A | * | 9/1977 | Lo et al. | 222/95 |
| 4,328,843 | A | * | 5/1982 | Fujii | 141/1 |
| 4,340,054 | A | * | 7/1982 | Michaels | 604/892.1 |
| 4,478,044 | A | * | 10/1984 | Magid | 60/721 |
| 4,679,706 | A | * | 7/1987 | Magid et al. | 222/130 |
| 5,054,651 | A | * | 10/1991 | Morane | 222/1 |
| 5,423,454 | A | * | 6/1995 | Lippman et al. | 222/1 |
| 6,874,659 | B2 | * | 4/2005 | Schiestl et al. | 222/94 |
| 7,185,786 | B2 | * | 3/2007 | Krause et al. | 222/1 |
| 2006/0049215 | A1 | | 3/2006 | Lim et al. | |
| 2008/0116228 | A1 | * | 5/2008 | Ryan et al. | 222/386.5 |

FOREIGN PATENT DOCUMENTS

| | | |
|---|---|---|
| WO | WO2008/053215 | 5/2008 |
| WO | WO2008/060152 | 5/2008 |

* cited by examiner

METHOD AND A SYSTEM FOR PRESSURISING AND DISPENSING FLUID PRODUCTS STORED IN A BOTTLE, CAN, CONTAINER OR SIMILAR DEVICE

CROSS-REFERENCE TO RELATED APPLICATION

This application is a national phase filing, under 35 U.S.C. §371(c), of International Application No. PCT/EP2010/054878, filed Apr. 14, 2010, the disclosure of which is incorporated herein by reference in its entirety.

FEDERALLY SPONSORED RESEARCH OR DEVELOPMENT

Not Applicable

BACKGROUND

The present invention relates to a method and a system for pressurising and dispensing fluid products stored in a bottle, can, container or similar device.

Fluid products such as liquids, pastes, gels, foams and the like are often stored in sealed and pressurized containers such as cans. Such pressurized containers typically have a dispensing device for allowing a controlled dispensing of the fluid product. The dispensing device includes a dispensing valve which is normally in a closed non-dispensing position preventing any fluid product from leaving the container. The dispensing valve may selectively by user interaction be temporarily switched to an open dispensing position allowing the fluid product to advance from an inner space inside the container towards the outside of the container. In some cases the fluid product should be dispensed in an aerosol state or spray state. In such cases the valve may preferably be of the well known "atomizer" type described in e.g. U.S. Pat. No. 1,800,156. Fluid products which are preferably dispensed in the form of an aerosol include hairspray, spray-paint and insect repellent. The pressurized container typically including a propellant gas subjecting the fluid product to a driving pressure for causing the product to flow out of the container through the dispensing device provided the valve is in its open position.

The propellant gas may in some cases be mixed together with the product, which may be particularly advantageous in case the fluid product should be dispensed as a foam, e.g. shaving foam, whipped cream, fire-extinguishing foam and the like. In other cases when the fluid product should be dispensed in the form of a gel or paste, e.g. body lotion, it is desired to separate the propellant gas from the fluid product. The separation may be achieved by a flexible membrane or the like which will allow pressure forces to be communicated between the fluid product and the propellant gas. In some cases the propellant gas is initially held liquefied at high pressure inside the container and vaporizes as the product is being dispensed and the pressure falls. The liquid and gaseous propellant then form an equilibrium for maintaining a constant high driving pressure. In some cases the propellant gas itself constitutes the fluid product, e.g. liquefied petroleum gas, which is stored partially in liquid state and partially in gaseous state.

The inner space of the pressurized container is divided into a pressure space, typically forming a head space of the container and including the propellant gas, and a product space including the fluid product. As the product dispensing is typically performed having the container in an upright position with the fluid product occupying the lower portion of the container and the propellant gas occupying the upper portion of the container, the dispensing device must include an ascending pipe for allowing the fluid product to be dispensed from the bottom of the container and avoiding propellant gas escaping from the pressure space at the top of the container. Alternatively, the pressure space and the product space may be physically separated by a flexible membrane as described above. For economic reasons the pressure space should be as small as possible for allowing small containers to be manufactured having a large amount of useful product.

When the product is being dispensed from the inner space of the container to the outside, the volume of the product space is being reduced. While dispensing, the product space is being substituted by the pressure space which thus will increase in volume. According to the universal gas law the driving pressure, which is the pressure inside the pressure space, will be reduced as the volume of the pressure space increases, provided the amount of gas and the temperature remain constant. For allowing the complete dispensing of the product, a sufficient driving pressure must still remain when the product is completed. The smallest sufficient driving pressure is contemplated to be between 0.1 bar above the atmospheric pressure for a substantially non-viscous product, up to 1 bar or more depending on the properties of the fluid product which is intended to be dispensed. Typically, a high initial pressure of the propellant gas in the pressure space is needed for allowing a sufficiently high pressure to remain in the pressure space for the product to be completely dispensed. Initial driving pressure as high as 6-12 bar and more are commonly used in conventional pressurized cans, such as spray cans, for allowing a driving pressure of about 1 bar to remain after the dispensing of the product has been completed.

The initially high driving pressure will sink significantly when some amount of the product has been dispensed due to the volume increase of the pressure space. A large difference in the driving pressure during the lifetime of the product is undesired, since the initial dose of product will be dispensed at a high driving pressure and the final dose of product will be dispensed at a low driving pressure. The difference in driving pressures between a container being full of product compared to a container where the product is nearly completely dispensed yields an entirely different dispensing behaviour for the initial dose of product and the final dose of product. An unexpectedly high driving pressure may surprise some users and cause an excessive amount product to be dispensed, while a low driving pressure may cause a slow dispensing of the product thereby extending the dispensing time. For some products the successful usage of the product depends entirely on the driving pressure, e.g. sprays and foams typically need a specific driving pressure for a correct spray/foam formation, and the application of the product may be complicated in case the actual driving pressure varies from the specific driving pressure. It is therefore a need for technologies for maintaining a substantially constant dispensing pressure during the complete useful lifetime of the dispenser assembly.

It has been experienced by users that the amount of propellant gas in some cases is insufficient and the driving pressure is below the limit for allowing dispensing before dispensing of the product is completed. The limit for allowing dispensing may be different for different products, but it is contemplated that the driving pressure must remain between 0.1 and 2 bar, typically 0.5 bar, above the atmospheric pressure for overcoming the flow resistance in the dispensing device and achieving a suitable dispensing performance. Normally, the user has no possibility of re-pressurising the pressure space since the container is sealed and cannot be opened without the use of professional tools. In case of insufficient driving pressure, the dispensing operation must be interrupted and the user will typically have to consider the remaining product as being unrecoverable.

There may be several reasons for experiencing insufficient driving pressure in the pressure space, e.g. leakage from the container or improper handling of the container. A well known example of improper handling of the container is in the case of the container having a unitary inner space, i.e. no separation between the pressure space and the product space, to place the container upside down, thereby dispensing from the pressure space instead of from the beverage space. Such a dispensing position may deplete the propellant gas within a short time, rendering the remaining product inaccessible. It is thus an object of the present invention to provide a product dispenser assembly capable of substituting the complete product space by the pressure space while maintaining a substantially constant driving pressure.

Various prior art documents suggest the use of a reserve gas supply for re-establishing the driving pressure when the driving pressure decreases, thereby preventing or at least delaying a complete depletion of the driving pressure. Some prior art documents suggest the provision of a high pressurized cartridge for supplying gas to the pressure space via a mechanical pressure limiter in case the driving pressure falls below a certain limit, where the limit corresponds to the lowest driving pressure considered to allow a suitable dispensing behaviour. Such technologies have the drawback of being dependent on a mechanical pressure limiter which is expensive and may fail or jam. Failing or jamming pressure limiters may cause an insufficient or an excessive pressure in the pressure space. By having an insufficient pressure in the pressure space the dispensing operations may be discontinued, and by having an excessive pressure in the pressure space a safety hazard may arise due to the risk of explosion of the container. Therefore an intrinsic pressure limitation mechanism is preferred. An example of an intrinsic pressure limiter is presented in US 2006/0049215 where a gas-adsorbing material is used as a reserve gas supply. The gas-adsorbing material may store a large amount of gas within a small volume. The gas is being released from the gas-adsorbing material in response to a driving pressure decrease in the container. The gas-adsorbing material is being wetted with a release-promoting agent for allowing improved release of gas. The gas adsorbing material of the above technology will thus be able to react on and compensate for a pressure decrease in the container by releasing previously stored gas.

In addition to the reduction of the driving pressure caused by the dispensing of the product, leakage of propellant gas and incorrect dispensing operation, which all constitute a permanent loss of driving pressure and has been discussed above, a temporary variation of the driving pressure may be caused by temperature variations in the pressure space of the container. It is well known from the universal gas law that the pressure of a gas depends linearly on the temperature of the gas. Thus, when the pressure space is being subjected to an increased temperature, the driving pressure in the pressure space will be increased as well. The pressure space may be subjected to an increased temperature unintentionally e.g. in case the product container is being stored inside an automobile or similar closed compartment during sunshine. Such temperature effects are well known among users of pressurized containers, and therefore most pressurized containers have labels indicating the maximum storage temperature of the container.

Most containers are pressurized for having a suitable dispensing behaviour around a certain temperature, typically room temperature, i.e. 20° C. In some cases undesired dispensing behaviour may result when a user tries to dispense the product while the container is exposed to a temperature different from room temperature. For example, dispensing from a container which has been stored at a cold temperature, such as 0° C., may result in an insufficient amount of product being dispensed since the driving pressure in the pressure space is lower than it would be at 20° C. Oppositely, when dispensing from a container having a higher temperature than room temperature, such as 50° C., the amount of product being dispensed and the dispensing velocity may be excessive, since the driving pressure in the pressure space is much higher than it would be at room temperature.

In addition to unsuitable dispensing behaviour, high temperatures also constitute a safety risk when handling pressurized containers. Conventional pressurized containers should not be exposed to excessive temperatures since a substantial temperature increase in the pressure space, e.g. by accidental heating, may cause the pressure to increase above the structural pressure limit of the container and the container may consequently rupture or explode. Such ruptures or explosions may cause harm to persons or property located close to the container. Therefore it is a further object of the present invention to provide product dispensing assemblies capable of maintaining or at least substantially maintaining the driving pressure during temperature variations, at least for temperature variations within 3-50° C. and preferably higher temperatures.

Due to the high initial pressures of 6-12 bar used in conventional pressurized containers and the even higher pressures which may occur during accidental heating, the materials used for the container must be substantially rigid for avoiding leakage and ensuring the structural stability of the container even when subjected to high driving pressure forces. Typically metal must be used for the container since plastics and glass are not capable of maintaining the high initial driving pressure, or at least not the occasional higher pressure forces in the pressure space resulting from elevated temperatures. It would therefore be an advantage to be able to use reduced initial pressures, in the range of about 0.1-2 bar and preferably not exceeding 2 bar. Lower initial pressures are preferred since it would allow containers made of other materials than metal, such as plastics. It would further allow thinner containers, more flexible containers and transparent containers. It is therefore yet a further object of the present invention to provide a product dispensing assembly maintaining an initial pressure of no more than 2 bar.

SUMMARY

The above needs, advantages and objects together with numerous other needs, advantages and objects which will be evident from the below detailed description are according to a first aspect of the present invention obtained by a self regulating and constant pressure maintaining product dispenser assembly comprising a dispensing device and a product container, the product container defining an inner space, the inner space comprising:

a product space being filled with a fluid product constituting a carbonated beverage, the product space communicating with the dispensing device for allowing a controlled dispensing of the carbonated beverage from the product container, and a pressure space being filled with a propellant gas having an initial pressure of 0.1-3 bar, preferably 0.2-2.5 bar, such as 0.3-2.0 bar, further preferably approximately 0.5-1.8 bar, above the atmospheric pressure when subjected to a specific temperature range of 0° C.-90° C., such as 0° C.-80° C., preferably 2° C.-60° C., further preferably 3° C.-50° C., the pressure space comprising a particular amount of an adsorption material being kept in a dry environment and having adsorbed a specific amount of the propellant gas, the specific amount of the propellant gas being sufficient for allowing the pressure space to increase in volume and to substitute the product space when the carbonated beverage having the specific temperature range is being dispensed from the inner space by using the dispensing device while substantially maintaining the initial pressure, or at least a pressure within the range 0.1-3 bar, preferably 0.2-2.5 bar, such as 0.3-2.0 bar, further preferably approximately 0.5-1.8 bar, above the atmospheric pressure, in the pressure space during the complete substitution of the product space by the pressure space, the particular amount of adsorption material being inherently capable of substantially maintaining the initial pressure in the pressure space by:

releasing the propellant gas into the pressure space when the pressure in the pressure space is decreased in relation to the initial pressure due to a temperature drop in the pressure space, and adsorbing the propellant gas from the pressure space when the pressure in the pressure space is increased in relation to the initial pressure due to a temperature raise in the pressure space.

Carbonated beverages include various types of sparkling beverages having a certain amount of $CO_2$ (carbon dioxide) dissolved in the aqueous content of the beverage. The exact amount of $CO_2$ may differ between different kinds of carbonated beverage. When the product space is filled with carbonated beverage, the pressure space may typically be filled with $CO_2$ as propellant gas. Loss of carbonisation resulting from e.g. extended time periods of storage in-between servings may cause the carbonated beverage to become flat and less tasty. The $CO_2$ dissolved in the carbonated beverage form a pressure equilibrium with the $CO_2$ in the pressure space and the $CO_2$ in the adsorption material. Thus, provided the propellant gas is $CO_2$ and direct contact between the product space and the pressure space is permitted, the driving pressure must correspond to the carbonisation level of the beverage. A higher or lower driving pressure may cause the beverage to become either over-carbonated or under-carbonated. By using $CO_2$ as propellant gas and storing $CO_2$ in the adsorption material the pressure in the pressure space may be maintained substantially constant. A constant $CO_2$ pressure in the pressure space allows a substantially constant carbonisation level to be maintained in the beverage and consequently preserving a state of equilibrium in the beverage.

The above needs, advantages and objects together with numerous other needs, advantages and objects which will be evident from the below detailed description are according to a second aspect of the present invention obtained by a self regulating and constant pressure maintaining product dispenser assembly comprising a dispensing device and a product container, the product container defining an inner space, the inner space comprising:

a product space being filled with a fluid product, the fluid product excluding carbonated beverages and gaseous products, the product space communicating with the dispensing device for allowing a controlled dispensing of the fluid product, and a pressure space being filled with a propellant gas having an initial pressure of 0.1-3 bar, preferably 0.2-2.5 bar, such as 0.3-2.0 bar, further preferably approximately 0.5-1.8 bar, above the atmospheric pressure when subjected to a specific temperature range of 0° C.-90° C., such as 0° C.-80° C., preferably 2° C.-60° C., further preferably 3° C.-50° C., the pressure space comprising a particular amount of an adsorption material being kept in a dry environment and having adsorbed a specific amount of the propellant gas, the specific amount of the propellant gas being sufficient for allowing the pressure space to increase in volume and to substitute the product space when the fluid product having the specific temperature range is being dispensed from the inner space by using the dispensing device while substantially maintaining the initial pressure, or at least a pressure within the range 0.1-3 bar, preferably 0.2-2.5 bar, such as 0.3-2.0 bar, further preferably approximately 0.5-1.8 bar, above the atmospheric pressure, in the pressure space during the complete substitution of the product space by the pressure space, the particular amount of adsorption material being inherently capable of substantially maintaining the initial pressure in the pressure space by:

releasing the propellant gas into the pressure space when the pressure in the pressure space is decreased in relation to the initial pressure due to a temperature drop in the pressure space, and absorbing the propellant gas from the pressure space when the pressure in the pressure space is increased in relation to the initial pressure due to a temperature raise in the pressure space.

In the second aspect gaseous products are excluded from the definition of fluid products, since gaseous products may be compressed and stored under pressure in a compressed state and therefore the gaseous product may itself provide the necessary driving pressure for the product to be driven out by its own pressure. In addition, carbonated beverages are excluded and handled by another aspect of the present invention, since the carbonated beverages will form a state of equilibrium with the propellant gas in case $CO_2$ is used as propellant gas. All other types of non-gaseous and substantially non-compressible substances having fluid or semi-fluids properties such as liquids, granulates, gels, pastes, and foams are understood to be encompassed in the definition of fluid product. The use of carbon dioxide ($CO_2$) as a propellant gas for non-beverage products is understood to be encompassed within the scope of the second aspect. $CO_2$ may be used as propellant gas for various products such as paints, gels, oils, etc without carbonating the product or otherwise react with the product. $CO_2$ is also considered as a cheap and environmentally friendly propellant gas. The fluid product is understood to be including any form of liquids, pastes, gels, granulates and combinations thereof, except the ones explicitly excluded above, such as one or more of the fluids chosen from the appended non-exhaustive list of fluid products.

The following passages describe content which is relevant in relation to both the first aspect and the second aspect of the present invention:

By self regulating is in the present context understood that the driving pressure regulation is inherent in the product dispensing assembly without the need for any external supply or reservoir of propellant gas. The pressure should be maintained substantially constant from the initial dispensing operation until the product is completed for avoiding reduced product dispensing performance which may result in case the pressure is reduced after the initial dispensing operation. The container may be a can or bottle or the like and may be made of metal or preferably plastic. The container defines an inner space for accommodating the fluid product. The product space is understood to be the portion of the inner space in which the fluid product is stored and typically occupies the greater part of the inner space.

The inner space further comprises the pressure space which is typically occupying a smaller portion of the inner space. The pressure space is filled with a propellant gas exhibiting a driving pressure onto the product space for providing a driving force on the fluid product. The driving pressure is elevated in relation to the pressure outside of the container. The inner space is sealed off pressure tight in relation to the outside, and communication to the outside is provided via the dispensing device only. The dispensing device comprises a dispensing valve for selectively allowing the fluid product in the product space to leave the inner space and be dispensed to the outside. The dispensing valve is normally in a closed position, preventing product dispensing. When product dispensing is desired, the dispensing valve may selectively and temporarily be switched to an open position, thereby initiating the product dispensing operation. The dispensing device communicates with the product space and may include an ascending pipe. Direct communication between the dispensing device and the pressure space should be avoided since it may result in propellant gas escaping through the dispensing device. When the product dispensing is being performed, the volume of the product space decreases and the volume of the pressure space increases. The volume of the inner space of the container remains substantially constant.

The pressure space should subject the product space to a driving pressure for allowing the fluid product to the propelled to the outside via the dispensing device. A particular amount of adsorption material which is sufficient for adsorbing a specific amount of propellant gas sufficient for substituting the complete product space without any significant loss of the initial driving pressure is provided in the pressure space. The driving pressure is understood to be the pressure difference between the pressure space and the outside. A certain minimum driving pressure is needed for dispensing the fluid product. By choosing an adsorption material having a high adsorption capability the pressure space may be small in relation to the product space which will reduce the size of the container. The adsorption material should have an inherent capability of both adsorbing and releasing propellant gas depending on the pressure in the pressure space. A reduction of the driving pressure in the pressure space will be immediately counteracted by an inherent release of propellant gas from the adsorption material for substantially neutralizing the pressure reduction and maintaining the initial pressure.

In the present context it is understood that a certain loss of driving pressure in the pressure space is unavoidable during the complete dispensing of the fluid product. The pressure loss is inherently depending on the particular amount of adsorption material. In some embodiments where constant driving pressure is important it may be considered to provide a large amount of adsorption material for storing a larger amount of propellant gas for the loss of driving pressure to be low and the driving pressure to be considered to be substantially maintained. In other embodiments it may be sufficient to maintain a driving pressure which is lower than the initial driving pressure and a smaller amount of adsorption material may be provided capable of storing only a smaller amount of propellant gas. The loss of driving pressure will consequently be larger during the complete dispensing process. It is contemplated that some extra amount of propellant gas should be stored in the adsorption material for the purpose of compensating for leakage which may become relevant during long time storage. Some products, such as fire-extinguishing products, may be stored for years in-between each dispensing operation, however, such products must always maintain a sufficient driving pressure for allowing immediate user selective dispensing of the product when required.

The initial pressure of the pressure space should be about 0.1-3 bar, preferably 0.2-2.5 bar, such as 0.3-2.0 bar, further preferably approximately 0.5-1.8 bar, above the outside pressure, depending on the nature of the fluid product, to allow a suitable product dispensing behaviour. It is contemplated that different products require different driving pressures for being dispensed in a suitable amount at a suitable velocity. Highly viscous products, such as honey, syrup and various oils, paints, gels and pastes, typically require a higher driving pressure than less viscous products such as alcohol, petrol, water and most beverages. During subsequent product dispensing operations, the pressure space will increase and the product space will reduce according to the amount of dispensed product until the product space is depleted and the total amount of product has been dispensed. During dispensing of beverage it is contemplated that some pressure loss may occur, however, the pressure should remain at least above the minimum dispensing pressure at all times until the product has been dispensed. It is further contemplated that product dispensing should be performed having the beverage container in a correct orientation, since the total amount of propellant gas may be quickly depleted in case of improper orientation of the product container, e.g. by holding the product container in an upside down orientation.

In conventional product dispenser assemblies, a driving pressure of 0.1-3 bar above the outside pressure would not be sufficient for substituting the product space and completing the dispensing of the product, assuming a small pressure space in relation to the product space. In case the driving pressure falls below the minimum dispensing pressure, the dispensing operation is interrupted and the residual product will be lost. By including the particular amount of adsorption material having adsorbed the specific amount of gas in the pressure space, the driving pressure may be held substantially constant at the initial pressure of 0.1-3 bar, or at least not fall below 0.1 bar, until the complete product space is depleted and substituted by the pressure space. Without the provision of the particular amount of adsorption material having adsorbed the specific amount of gas in the pressure space, the pressure in the pressure space would quickly reduce, and the dispensing operations would end due to lack of driving pressure before the product has been completely dispensed. The particular amount of adsorption material and the specific amount of gas should be sufficient for substituting the complete product space, without leaving any residual product when the driving pressure and the outside pressure have equalized.

In the present context it has been surprisingly found out that to maintain a lower initial driving pressure of e.g. 2 bar a considerable smaller amount of adsorption material is required than for maintaining a higher pressure of e.g. 5 bar. Thus, by limiting the initial pressure to no more than 2 bar above the pressure outside the product container, a small amount of adsorption material will suffice for substantially maintaining the initial driving pressure, or at least a driving pressure above e.g. 0.5 bar above the pressure outside the product container, for the dispensing of the fluid product until the fluid product is completely dispensed.

It is well known from the universal gas law that the pressure of a given gas volume varies with temperature. Most commercial fluid products are intended to be dispensed at temperatures around room temperature and the driving pressure of the propellant gas in the pressure space of a typical product dispenser assembly is adjusted to be suitable for dispensing operations in room temperature. In some cases the product container will be exposed to temperatures being different from room temperature and the temperature may be both higher and lower than the room temperature. A higher temperature in the pressure space will cause the driving pressure to increase while a lower temperature will cause a reduction in driving pressure. It is contemplated that the product dispenser assembly may be exposed to temperatures between 0° C. and 90° C., or at least 3° C. and 50° C., during normal operating conditions. A rise in driving pressure resulting from subjecting the product container to high temperatures is a well known phenomenon among users of pressurized containers and may lead to high dispensing velocity and/or an undesired dispensing behaviour and/or spillage. A reduction in driving pressure resulting from subjecting the product container to low temperatures is equally well known among users of pressurized containers and may lead to slow dispensing velocity which may sometimes cause the product user to falsely believe that the fluid product is completely dispensed.

In cases of a temporary decrease of the driving pressure caused by e.g. drop of the temperature in the pressure space, the adsorption material will counteract the pressure variation by releasing some propellant gas and thereby maintaining the pressure. In addition to being able to release propellant gas for maintaining the pressure in the pressure space, the particular amount of adsorption material is able to compensate for an increase of the driving pressure caused by e.g. a temperature raise in the pressure space by re-adsorbing the excessive propellant gas. It is an inherent feature of the adsorption material to be able to both release (desorb) and adsorb propellant gas. Since the pressure may vary in both directions, i.e. increase or decrease, the adsorption material is capable of releasing propellant gas in case of temperature reduction and re-adsorbing propellant gas in case of a temperature increase, thereby compensating for temperature dependent variations of the driving pressure in the pressure space for maintaining a substantially constant driving pressure over a broad temperature range. The adsorption material will constantly regulates the driving pressure in the pressure space by inherently releasing and re-adsorption of propellant gas in reaction to pressure variation without any of the propellant gas being lost. Since the pressure maintaining feature of the adsorption material is inherent and involves no moving parts, the risk of malfunction is minimal.

For the adsorption material to work properly, it is necessary to keep it in a dry state. Any fluid product or other fluid substance contacting the adsorption material may be accidentally absorbed by the adsorption material. Such accidentally adsorbed substances may reduce the ability of the adsorbing material to adsorb and release propellant gas. Therefore, the adsorbing material should preferably be subjected to propellant gas only.

According to a further embodiment of any of the above aspects, the pressure space has an initial pressure of no more than 2 bar above the atmospheric pressure, preferably no more than 1.5 bar above the atmospheric pressure, more preferably no more than 1 bar above the atmospheric pressure and most preferably no more than 0.5 bar above the atmospheric pressure. A smaller initial pressure is typically preferred for achieving a suitable dispensing velocity and avoiding over-dispensing of the product and allowing a suitable dispensing behaviour. By using a particular amount of adsorption material which is sufficient for allowing the adsorption material to adsorb a specific amount of propellant gas sufficient for substituting the complete product space, the initial pressure in the pressure space and the canister can be maintained low without the need for having a very high pressure in the pressure and adsorbing material for allowing a complete substitution of the product space. As has already been discussed previously, maintaining a lower driving pressure requires a significantly smaller amount of adsorption material than maintaining a higher driving pressure.

According to a further embodiment of any of the above aspects, the pressure space, after the complete substitution of the product space by the pressure space, has a pressure above the atmospheric pressure amounting to at least 60% of the initial pressure, preferably at least 70% of the initial pressure, more preferably at least 80% of the initial pressure and most preferably at least 90% of the initial pressure. As discussed above, a certain pressure loss in the pressure space is unavoidable, since maintaining 100% of the initial driving pressure over the lifetime of the product would require an infinite amount of adsorption material. However, the driving pressure must not be significantly reduced for maintaining good dispensing properties. The pressure should be maintained until the product is completely dispensed, or at least for an extended time period which may be comparable to the maximum storage time of the product, such as least a few months and more preferably a few years or more, depending on the kind of product. For maintaining a suitable dispensing behaviour, for the driving pressure it is contemplated that at least 60%, preferably at least 70%, more preferably at least 80% and most preferably at least 90% of the initial pressure remains after the product has been completely dispensed. Thereby, the last amount of product being dispensed just before the product is completely dispensed will be dispensed with substantially the same dispensing behaviour and quality as the initial dispensed product amount.

According to a further embodiment of any of the above aspects, the product space initially occupies at least 70% of the inner space, preferably 75%, more preferably 80% and most preferably 85%. The pressure space is a part of the inner space of the product container which does not contribute to the payload, i.e. the storing of the product, and may thus be considered a waste since the product container must be manufactured and transported having a larger inner space than actually needed for the product space. By using an efficient adsorbing material capable of storing the specific amount of propellant gas needed to substitute the product space within a small volume, the pressure space may be smaller, since initially the main purpose of the pressure space is for accommodating adsorption material. A reduction of the amount of adsorption material may be achieved by having a sufficiently low initial driving pressure as discussed above. For economic reasons, the pressure space should initially not occupy more than 30% of the inner space of the product container, leaving 70% of the inner space for the product space. Preferably, the product space initially occupies an even larger portion of the inner space and the pressure space a corresponding smaller portion.

According to a further embodiment of any of the above aspects, the adsorption material inherently adsorbs propellant gas when the product container is being heated above the specific temperature range for avoiding any substantial increase of the pressure in the pressure space. In some cases the product container may be heated above the specific temperature range, e.g. above 50° C. or above 90°. Such heating may occur accidental, e.g. due to fire, incoming solar radiation or warm climate, but also intentional, e.g. during disposal by combustion. In such cases the pressure will rise in the inner space. In typical product containers the pressure may rise to several tens of bar during heating until the structural limit of the container is reached and the container ruptures. Such ruptures may in some cases be explosive and damage to persons and/or property cannot be excluded. The pressure rise in the inner space will in the present case be counteracted by an increased adsorption of propellant gas by the adsorption material, thus by providing a suitable amount of adsorption material any substantial pressure increase may be avoided even when the product container is subjected to high temperatures. A product dispenser assembly being able to withstand high temperatures, such as temperatures exceeding 50° C., e.g. 100° C., 200° C. or even 500° C. without a significant pressure increase may thus be regarded as being explosion proof, which is an important safety feature. In some embodiments the container may be safely disposed by combustion while experiencing only a minor pressure increase without any explosive rupture of the product container.

According to a further embodiment of any of the above aspects, the pressure space and the adsorption material are being separated by a gas permeable, liquid impermeable membrane preventing any liquid or paste/gel communication between the pressure space and the adsorption material during the complete dispensing of the product, the membrane being e.g. the GORE-TEX™ membrane (where GORE-TEX™ is the trade name and in certain countries the registered trademark of W.L. Gore & Associates Inc). The adsorption material should be kept in a dry environment. In certain applications, the separation between the pressure space and the adsorption material may be provided by the use of a pair of check valves operated in parallel and opposite one another. By providing a gas-permeable, liquid impermeable membrane the adsorption material may be encapsulated and kept dry. The membrane is preferred due to the small size and high security of membranes compared to other types of hydrophobic materials. The membranes typically have pores being small enough for preventing liquid water molecules and the like from passing through, but allowing gaseous molecules to pass in both directions. One such membrane material is the well known GORE-TEX™, which is made from extruded PTFE (polytetrafluorethylene).

According to a further embodiment of any of the above aspects, the product container and the dispensing device consist entirely of disposable and/or combustible polymeric materials. The environmental concern is especially large for product dispensing assemblies, and combustion is considered to be an environmentally friendly method. Previously, the high pressure in the product space prevented the use of polymeric materials, and metal was used almost exclusively due to its rigidity. By using a lower pressure in the pressure space, the use of plastic and other polymeric materials is possible. Plastic is less rigid than metal, but plastic may be more easily disposed, e.g. by combustion, and may therefore be handled by normal domestic and public recycling facilities.

According to a further embodiment of any of the above aspects, the product space and the pressure space are being separated by a flexible and fluid tight wall preventing any fluid communication between the pressure space and the product space during the complete dispensing of the product. The inner space may in some cases be compartmentalized by e.g. a flexible inner wall or bag delimiting the product space from the pressure space, and a flexible or preferably rigid outer container defining the inner volume and the pressure space being defined between the inner bag and the outer container. Such technologies are well known from e.g. bag-in-box and bag-in-container concepts and are suitable in case the propellant gas should not be in contact with the product, such as in case the propellant gas is toxic or reactive with the product. For example in case $CO_2$ is used as propellant gas and the product is aqueous, the product will become carbonated in case the propellant gas comes into direct contact with the product, which may be undesired for e.g. body lotions etc. Additionally, the ascending pipe may be omitted when using a flexible wall. Flexible wall should in the present context be understood to encompass deformable walls, elastic walls and movable walls. In some embodiments it may even be desired to separate the pressure space by having a separate compartment for storing the adsorption material. Such separate compartment may even be located outside the container and communicating with the proper pressure space via a tube. Concerning some other products, such as e.g. shaving foam and aerosol products, the inner space must be unitary for allowing the product to mix with the propellant gas for the foam or aerosol to be established.

According to a further embodiment of any of the above aspects, the mass of the particular amount of adsorbing material amounts to approximately 1%-10%, preferably 2%-5%, more preferably 3%-4%, of the initial mass of the product in the product space. It is preferred to use as small amounts of adsorbing material as possible since the adsorbing material does not contribute to storing beverage and may thus be considered a waste since a larger beverage dispensing assembly must be manufactured and transported to the customer. On the other hand, a large amount of adsorption material will allow smaller pressure variations and ensure a substantially constant pressure being maintained in the inner space from the initial dispensing operation until the product is completely dispensed. The amount of propellant gas being absorbed by the adsorbing material is dependent on the pressure in the pressure space and the mass of the adsorption material. Thus, it is clear that the mass of adsorption material is a trade-off between maintaining the pressure substantially constant and providing a small and light beverage dispensing assembly. It has been experimentally found out that having adsorption material having the above mass in relation to the mass of the beverage will, when loaded with $CO_2$, be suitable for substituting the product space with $CO_2$ and maintaining the pressure substantially constant while not contributing significantly to the weight and size of the product dispensing assembly.

According to a further embodiment of any of the above aspects, the adsorption material comprises activated carbon. Preferably, activated carbon is used as the adsorption material, since it may adsorb and release sufficient large amounts of $CO_2$ for permitting a small pressure space in relation to the product space. Activated carbon also adsorbs and releases $CO_2$ sufficiently fast for allowing a continuous dispensing of product and a quick response to changing of the temperature and pressure inside the product container.

According to a further embodiment of any of the above aspects, the specific amount of propellant gas initially adsorbed by the adsorbing material is equal to 1-3 times, preferably 1.5-2.5 times, more preferably 1.8-2 times the volume of the product in the product space at atmospheric pressure. For being able to substitute one liter of beverage by propellant gas at a sufficient pressure of about 1 bar above the atmospheric pressure, the adsorbing material must be preloaded with about 2 liters of propellant gas. Having less amount of propellant gas will inevitably cause a pressure reduction in the pressure space as the product space is reduced.

According to a further embodiment of any of the above aspects, the propellant gas is chosen from among: $CO_2$, $N_2$, any of the noble gases such as He, Ne or Ar, any of the hydrocarbons such as propane, butane, isobutene, dimethylether, methyl, ethyl ether, or hydrofluoroalkanes, or a mixture of the above. The above list includes the most popular propellant gasses which are compatible with activated carbon and substantially non-toxic and inert.

The above needs, advantages and objects together with numerous other needs, advantages and objects which will be evident from the below detailed description are according to a third aspect of the present invention obtained by a method of producing a self regulating and constant pressure maintaining product dispenser assembly by providing a dispensing device and a product container defining an inner space, the method comprising the following steps:

establishing a product space and a pressure space within the inner space, filling the product space with a fluid product constituting a carbonated beverage, the product space communicating with the dispensing device for allowing a controlled dispensing of the carbonated beverage from the product container, and filling the pressure space with a propellant gas having an initial pressure of 0.1-3 bar, preferably 0.2-2.5 bar, such as 0.3-2.0 bar, further preferably approximately 0.5-1.8 bar, above the atmospheric pressure when subjected to a specific temperature range of 0° C.-90° C., such as 0° C.-80° C., preferably 2° C.-60° C., further preferably 3° C.-50° C., the pressure space comprising a particular amount of an adsorption material being kept in a dry environment and having adsorbed a specific amount of the propellant gas, the specific amount of the propellant gas being sufficient for allowing the pressure space to increase in volume and to substitute the product space when the carbonated beverage having the specific temperature range is being dispensed from the inner space by using the dispensing device while substantially maintaining the initial pressure, or at least a pressure within the range 0.1-3 bar, preferably 0.2-2.5 bar, such as 0.3-2.0 bar, further preferably approximately 0.5-1.8 bar, above the atmospheric pressure, in the pressure space during the complete substitution of the product space by the pressure space, the particular amount of adsorption material being inherently capable of substantially maintaining the initial pressure in the pressure space by:

releasing the propellant gas into the pressure space when the pressure in the pressure space is decreased in relation to the initial pressure due to a temperature drop in the pressure space, and adsorbing the propellant gas from the pressure space when the pressure in the pressure space is increased in relation to the initial pressure due to a temperature raise in the pressure space.

The above needs, advantages and objects together with numerous other needs, advantages and objects which will be evident from the below detailed description are according to a fourth aspect of the present invention obtained by a method of producing a self regulating and constant pressure maintaining product dispenser assembly by providing a dispensing device and a product container defining an inner space, the method comprising the following steps:

establishing a product space and a pressure space within the inner space, filling the product space with a fluid product, the fluid product including any form of liquids, pastes, gels, granulates and combinations thereof, the fluid product excluding carbonated beverages and gaseous products, the product space communicating with the dispensing device for allowing a controlled dispensing of the fluid product, and filling the pressure space with a propellant gas having an initial pressure of 0.1-3 bar, preferably 0.2-2.5 bar, such as 0.3-2.0 bar, further preferably approximately 0.5-1.8 bar, above the atmospheric pressure when subjected to a specific temperature range of 0° C.-90° C., such as 0° C.-80° C., preferably 2° C.-60° C., further preferably 3° C.-50° C., the pressure space comprising a particular amount of an adsorption material being kept in a dry environment and having adsorbed a specific amount of the propellant gas, the specific amount of the propellant gas being sufficient for allowing the pressure space to increase in volume and to substitute the product space when the fluid product having the specific temperature range is being dispensed from the inner space by using the dispensing device while substantially maintaining the initial pressure, or at least a pressure within the range 0.1-3 bar, preferably 0.2-2.5 bar, such as 0.3-2.0 bar, further preferably approximately 0.5-1.8 bar, above the atmospheric pressure, in the pressure space during the complete substitution of the product space by the pressure space, the particular amount of adsorption material being inherently capable of substantially maintaining the initial pressure in the pressure space by:

releasing the propellant gas into the pressure space when the pressure in the pressure space is decreased in relation to the initial pressure due to a temperature drop in the pressure space, and adsorbing the propellant gas from the pressure space when the pressure in the pressure space is increased in relation to the initial pressure due to a temperature raise in the pressure space.

It is evident that the product dispenser assemblies according to the first and second aspects of the present invention may be manufactured by the methods according to the third and fourth aspect of the present invention.

BRIEF DESCRIPTION OF THE DRAWINGS

A brief description of the figures follows below.

DETAILED DESCRIPTION

Figure 1:
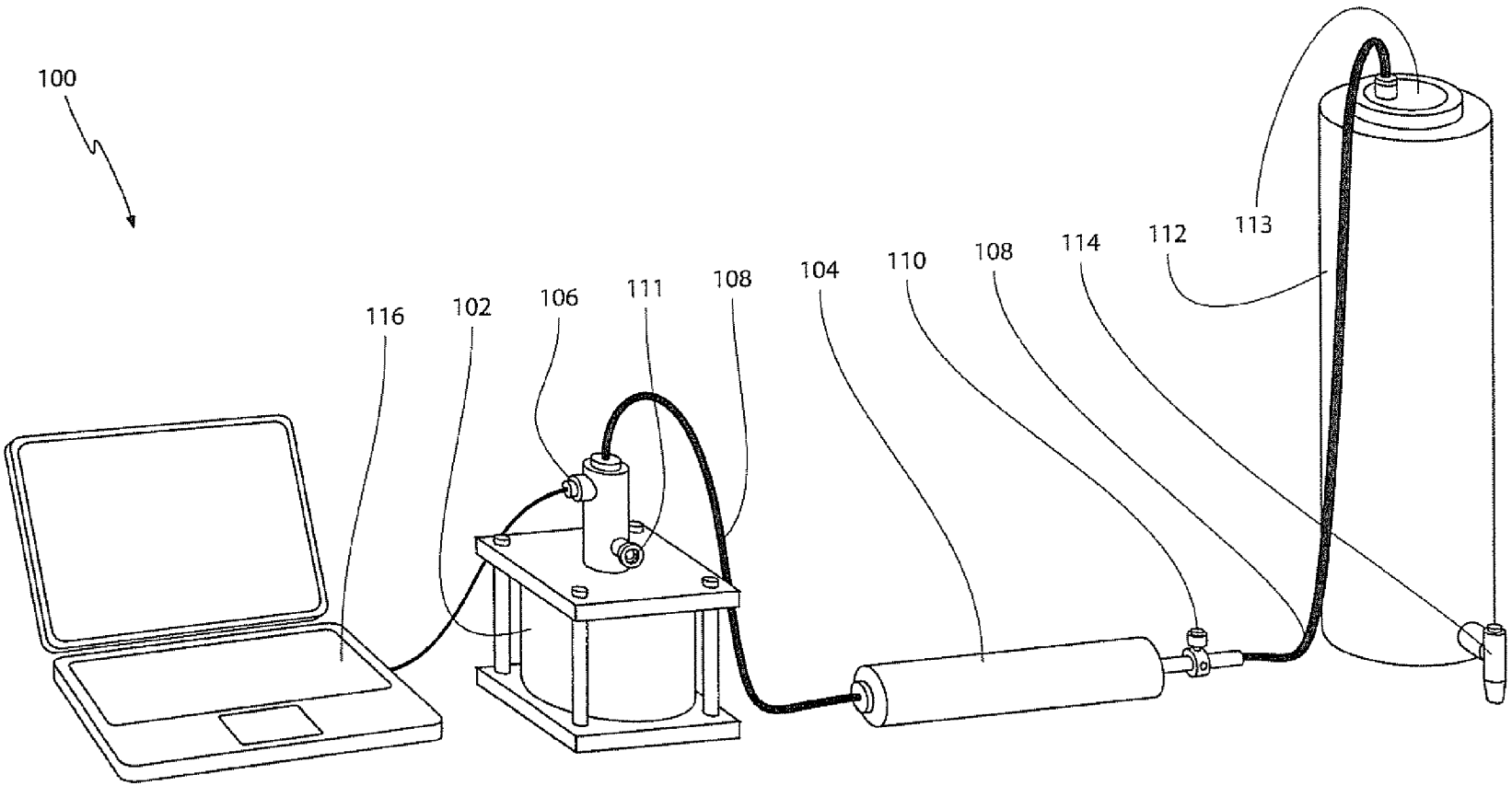
FIG. 1 is a first experimental embodiment of the product dispenser assembly according to the present invention.

A detailed description of the figures follows below:

FIG. 1 shows reusable product dispenser assembly 100 according to the present invention. The product dispenser assembly 100 is intended for experimental use and/or multiple use and may be especially suitable for use in smaller professional product dispensing establishments. The product dispenser assembly 100 comprises a canister (reusable) 102 made of metal or plastic or similar rigid material. The canister 102 is filled with adsorption material being preferably activated carbon. The canister 102 is connected to a cylinder 104. The cylinder 104 is filled with $CO_2$ as propellant gas and constitutes the initial pressure space. The cylinder 104 is connected to a product reservoir 112 via a pressure valve 110. The connections are made by pressure tight tubing 108. The product reservoir 112 constitutes the product space and is initially completely filled with a fluid product. The product constitutes a non-gaseous fluid product such as a liquid, a gel, a paste or a granulate which may optionally be chosen from the appended list of fluid products. The fluid product may be introduced into the product reservoir 112 by opening a pressure lid 113.

The canister 102 further comprises a pressure inlet 111, constituting a valve (not shown) and a quick connector for attaching a gas source (not shown). The canister 102 is initially loaded by closing the pressure valve 110 and attaching a vacuum source (not shown) for removing any traces of air from the canister 102 and subsequently attaching a $CO_2$ source (not shown) for loading the canister with a specific amount of $CO_2$. In the present research $CO_2$ is used as propellant gas and activated carbon as adsorption material. The $CO_2$ source (not shown) may subsequently be removed and the pressure inlet 111 is automatically closed off when removing the $CO_2$ and vacuum sources (not shown) for avoiding any leakage. Before the pressure valve 110 is opened, the product reservoir 112 is filled with the fluid product and the pressure lid 113 is sealed onto the product reservoir 112. When the pressure valve 110 is opened the product reservoir 112 is pressurised and product may be selectively dispensed by operating a dispensing faucet 114. The specific amount of $CO_2$ loaded in the adsorbing material should be sufficient for substituting the complete product reservoir 112.

The applicant has performed extensive experimental research as a proof-of-concept using the above product dispensing assembly 100. The product dispensing assembly 100 is used due to its reusable features allowing completely reproducible results. For experimental purposes, the canister 102 is further equipped with a pressure gauge 106 for continuously measuring the pressure inside the canister 102 and logging the results using a data recorder in the form of a laptop computer 116.

Figure 2A:
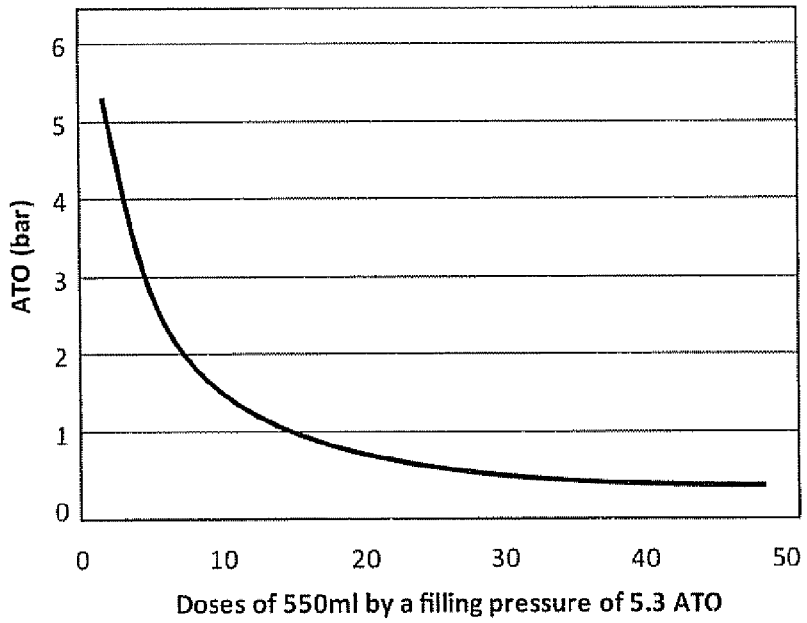
FIG. 2A-B is the results of the first proof-of-concept experiments performed with the above experimental embodiment.

In one experiment, 434 g of activated carbon obtained from the company "Chemviron carbon" and designated type "SRD 08091 Ref. 2592" is used as adsorbing material and stored inside the canister 102. The cylinder 104 constituting the pressure space is determined to be 980 ml. The canister 102 and cylinder 104 are loaded with different pressures, such as 5 bar or 1 bar above atmospheric pressure. The fluid product is subsequently dispensed in 550 ml doses. After each dispensed dose of product, the pressure decay in the canister 102 is monitored. The main results from the experimental research are presented below:

FIG. 2A shows the first results from experimental research described above in connection with FIG. 1. The volumes of the product reservoir, the activated carbon and the cylinder are held constant according to above and the initial $CO_2$ pressure is being varied. The graph shows the pressure decay resulting from the substitution of the product reservoir by $CO_2$ from the canister when the canister including activated carbon and the cylinder constituting the initial pressure space is initially having a pressure of 5.3 bar. The ordinate axis shows the pressure in the canister in ATO, being the pressure in bar above the atmospheric pressure. The abscissa axis shows the number of 550 ml doses of fluid product dispensed from the product container. It can be seen from the graph that the pressure is reduced from the initial 5.3 bar to less than 3 bar already after a few dispensing operations. However, most fluid products will not require such high pressures as 5 bar to remain in a dispensable condition. It has surprisingly been found out that when reaching lower pressures, the rate of pressure reduction decreases and the activated carbon can maintain the pressure for a greater amount of doses. After substituting about 14 fluid product dispensing doses of 550 ml per dose, a driving pressure of 1 bar remains in the pressure space from the original 5.2 bar. However, by substituting another 14 product dispensing doses of 550 ml per dose 0.5 bar driving pressure still remains.

Figure 2B:
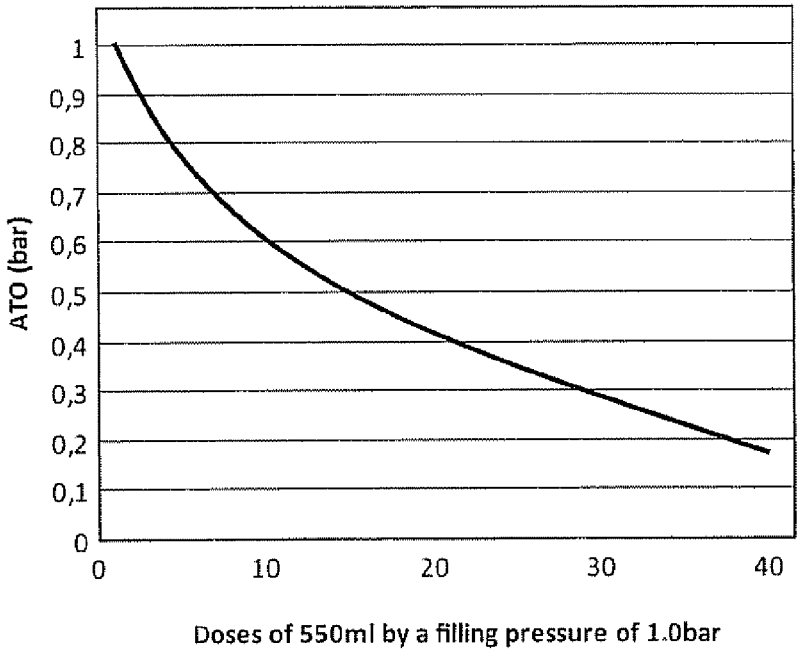

FIG. 2B shows another proof-of-concept experimental research with the activated carbon and the pressure space initially having a pressure of 1.0 bar. It can be seen that 1.0 bar allows more than 20 product dispensing doses of 550 ml per dose, in all more than 11 liters, before reaching the pressure of 0.4 bar, which in the present context is considered to be the lowest driving pressure for allowing a suitable product dispensing rate. The above experimental research has been performed at a temperature of 5° C. and 20° C. with substantially identical results, thus it has also been shown that the activated carbon maintains the driving pressure for variable dispensing temperatures.

Figure 3B:
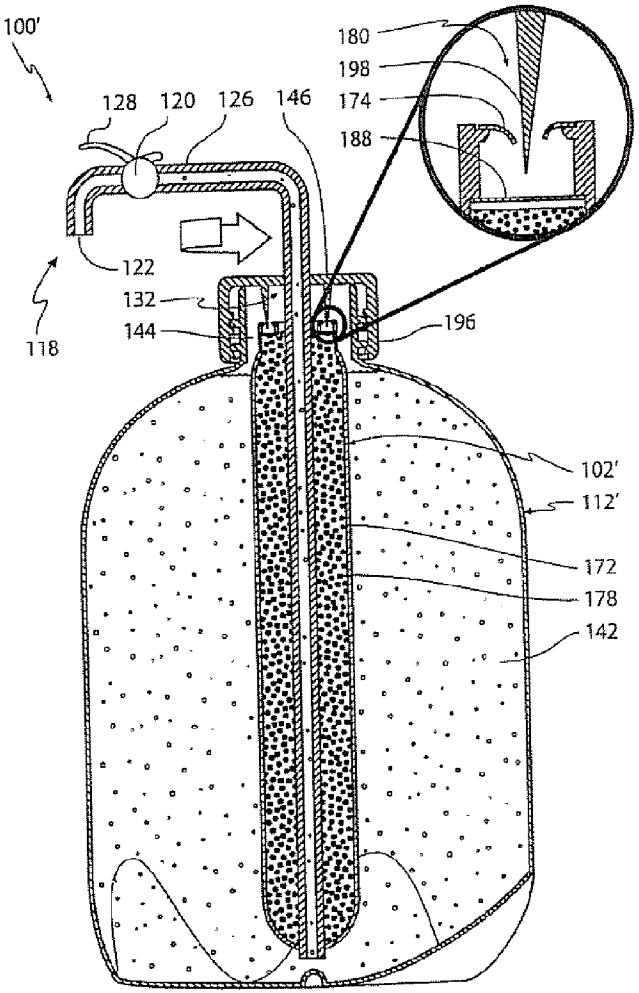
FIGS. 3A and 3B illustrate an alternative embodiment of the product dispenser assembly having a canister fixed to the tapping hose and a manually operated piercing element.
Figure 3A:
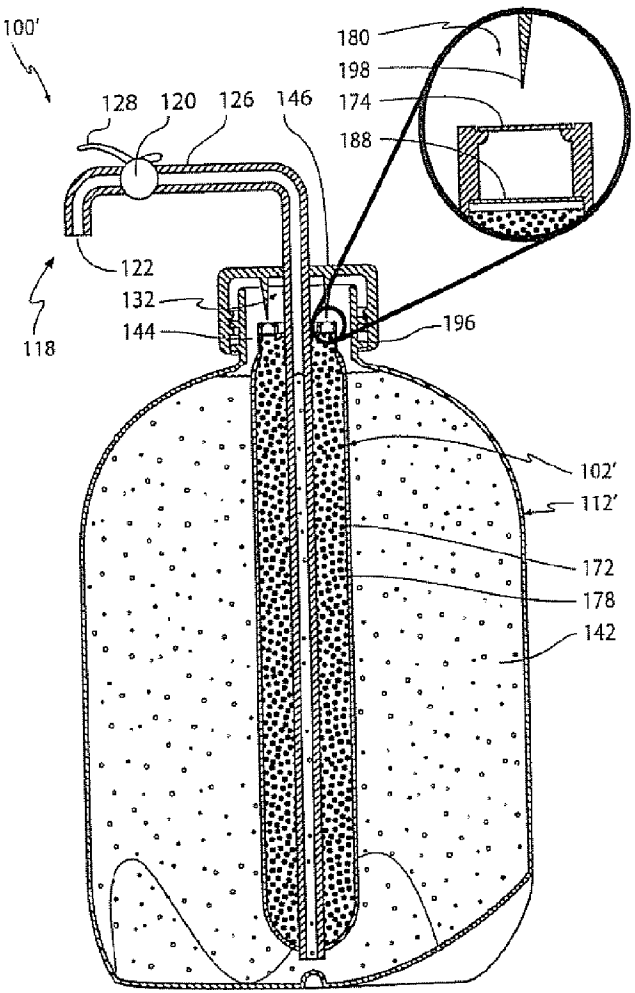

FIG. 3A shows a further embodiment of a product dispensing assembly 100' according to the present invention. The product dispensing assembly 100' comprises a product container 112'. The product container 112' has an opening 132, a product space 142 accommodating a fluid product and a pressure space 144 at the opening 132. The opening 132 is sealed by a base part 146. The base part 146 covers the complete opening 132 and is attached at a screw joint 196. The base part 146 further comprises a pair of inwardly oriented piercing elements 198, which will be explained in more details in connection with FIG. 3B. A product hose 126 extends through the base part 146 into the product space 142. The outwardly end of the product hose 126 comprises a tapping valve 120 for controlling the flow of product thorough the product hose 126. The tapping valve 120 is connected to a tapping handle 128 for operating the tapping valve 128. The tapping valve 120 has a product outlet 22 where fluid product will leave the tapping valve 120, provided the tapping handle 28 is being operated.

The interior of the product container 112' further comprises a canister 102. The canister 102' is fixed to the product hose 126 and extends between the product space 142 and the pressure space 144. The canister 102' is separated from the product space 142 and the pressure space 144 by an outer wall 172. The canister 102' defines an inner chamber 178 which is filled with adsorption material, preferably activated carbon. The activated carbon is pre-loaded with the specific volume of $CO_2$ being sufficient for substituting the complete product space 142 while substantially maintaining the pressure in the pressure space 144. The upper portion of the canister 102' comprises an initiator 180. The initiator 180 comprises a hydrophobic membrane 188 providing gaseous communication but preventing liquid communication between the pressure space 144 and the inner chamber 178 for keeping the activated carbon in a dry condition. The initiator 180 further comprises a burst membrane 174 located above the hydrophobic membrane 188 and initially preventing fluid communication between the pressure space 144 and the inner chamber 178.

FIG. 3B shows the product dispensing assembly 100' during activation. The product dispensing system 100' should be activated by rupturing the burst membrane 174 before use of the product dispensing system 100' for allowing gaseous communication between the pressure space 144 and the inner chamber 178 for permitting continuous product dispensing and maintaining the pressure in the pressure space 144 by release of $CO_2$ from the activated carbon. The burst membrane 174 is ruptured by rotating the base part 146. By rotating the base part 146, the screw joint 196 causes the base part 146 and the piercing elements 198 to move inwardly towards the burst membrane 174 for allowing the piercing elements 198 to tear the burst membrane 174, thereby activating the product dispenser system 100'.

The fluid product may be dispensed by operating the tapping handle 128, causing the tapping valve 120 to assume open state and allow product to flow from the product space 142 via the product hose 126 to the product outlet 122. As the fluid product is being dispensed, the product space 142 decreases in volume while the pressure space 144 increases in volume and substitutes the product space 142. While the pressure space 144 increases in volume, the activated carbon in the inner chamber 178 of the canister 102' releases $CO_2$ for substantially maintaining the pressure inside the pressure space 144.

Figure 4B:
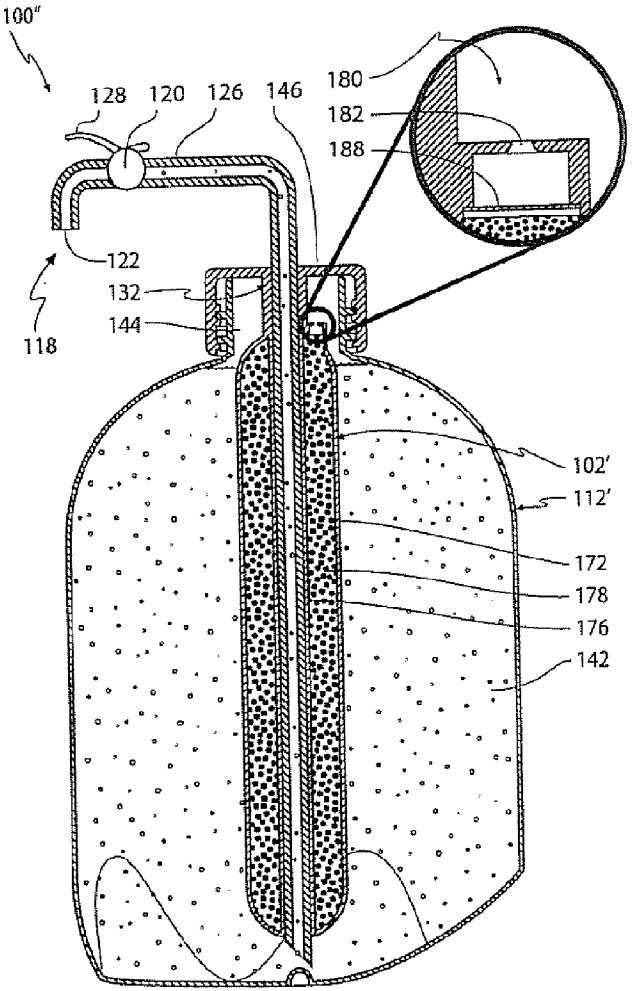
FIGS. 4A and 4B illustrate an alternative embodiment of the product dispenser assembly where the tapping hose is provided separately having a rupturable membrane.
Figure 4A:
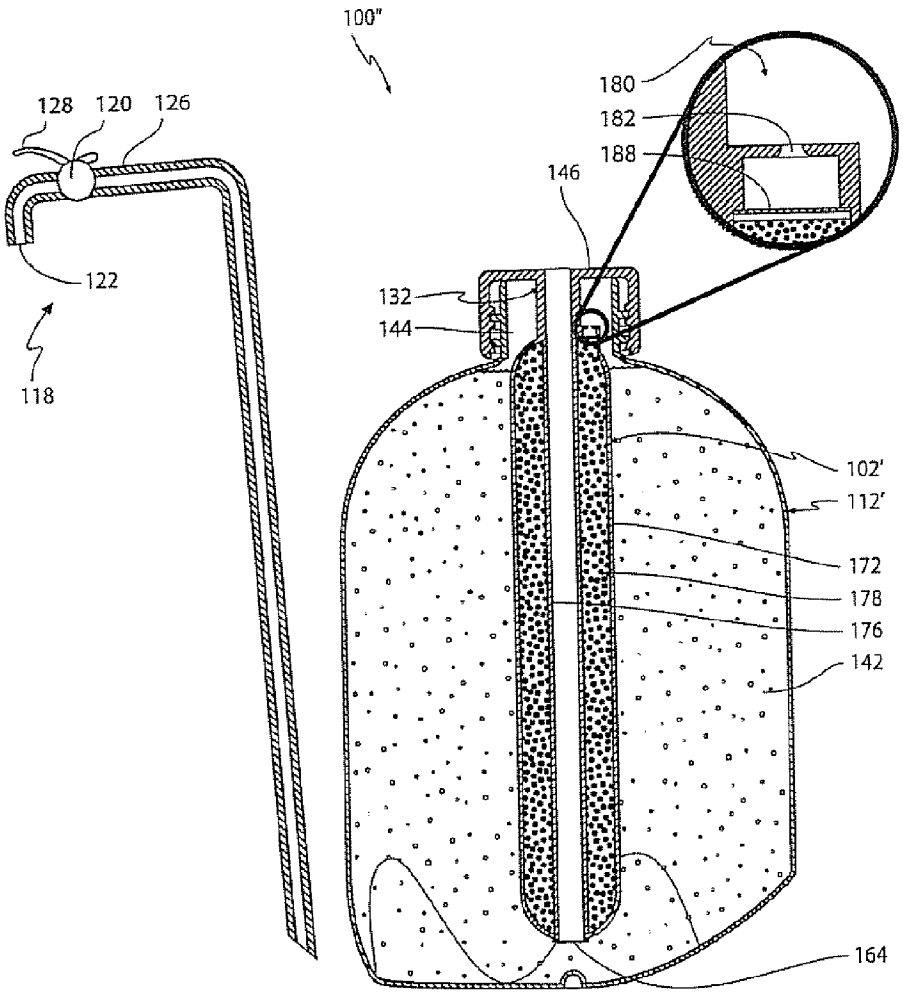

FIG. 4A shows yet an alternative embodiment of a product dispensing assembly 100" according to the present invention. The product dispensing assembly 100" is similar to the product dispensing assembly 100' of FIG. 3, however, the tapping hose 126 is provided as a separate accessory which is being installed by the user before the first product dispensing operation. The canister 102' comprises an inner wall 176 extending from the base part 146 to the bottom of the canister 102' and defining a pass through channel from the base part 146 through the complete canister 102'. Access to the product space 142 is prevented by a pierceable membrane 164 near the bottom of the product space 142. The canister 102' comprises an initiator 180 at the pressure space 144. The initiator 180 composes the hydrophobic labyrinth 188 and a flow restrictor in the form of a nozzle 82.

FIG. 4B shows the activation of the product dispensing assembly 100" by inserting the product hose 126 into the pass through channel defined by the base part 146 and the inner wall 176. The product hose 126 pierces the pierceable membrane 164 and thereby the end of the product hose 126, which should be sharpened for the purpose of easier piercing, enters the product space 142. The product hose 126 should establish a fluid tight connection to the inner wall 176. The fluid product may then be dispensed by operating the handle 128 as explained above. It should be noted that in the present embodiment the burst membrane is omitted thereby permanently allowing gaseous communication between the pressure space 144 and the inner chamber 178. The nozzle 182 prevents a too quick compensation of the pressure in the pressure space 44.

Figure 5B:
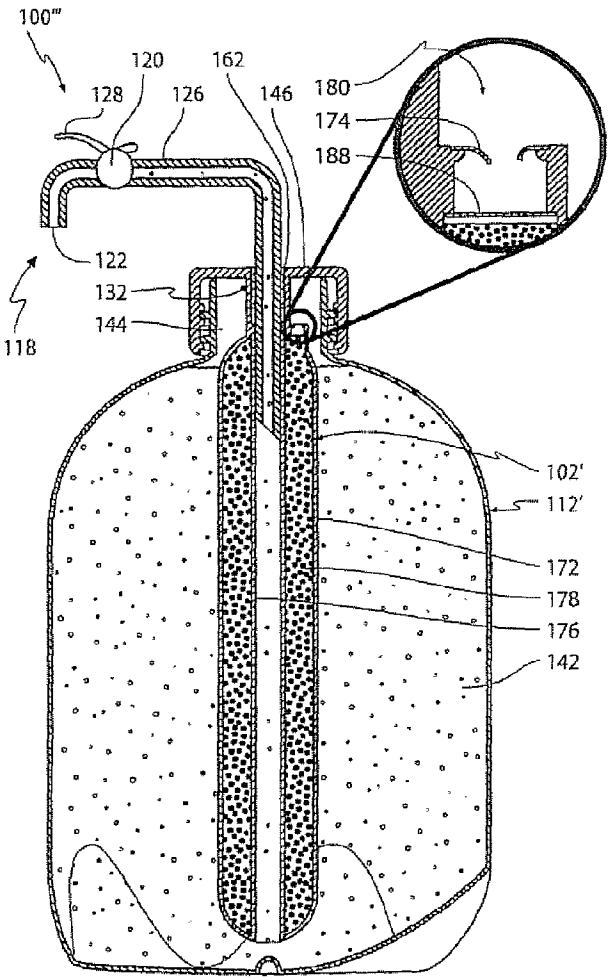
FIGS. 5A and 5B illustrate an alternative embodiment of the product dispenser assembly where the tapping hose is provided separately having a burst membrane
Figure 5A:
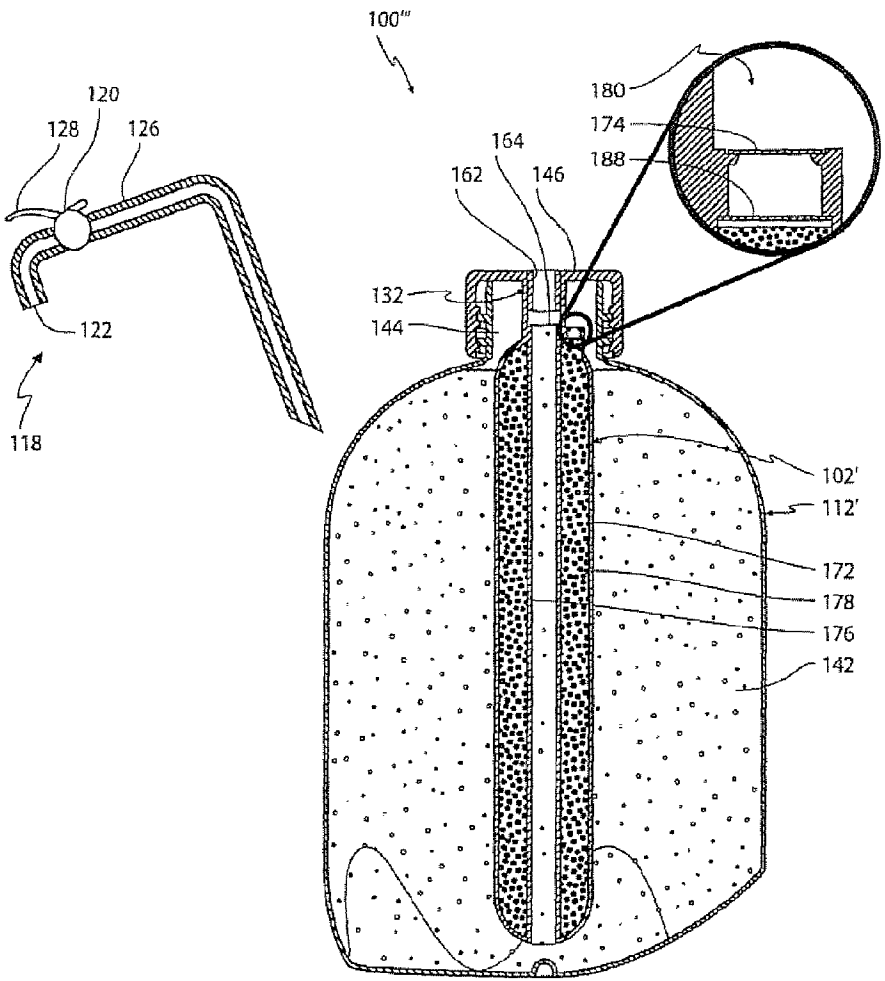

FIG. 5A shows yet an alternative embodiment of a product dispensing assembly 100'" according to the present invention. The product dispensing assembly 100'" is similar to the product dispensing assembly 100" of FIGS. 4A and 4B, and likewise, the tapping hose 126 is provided as a separate accessory which is being installed by the user before the first product dispensing operation. The tapping hose 126 may however be shorter than in the previous embodiment since the pierceable membrane 164 is placed in a plug 162 which is accommodated in the base part 146. The activator includes a burst membrane 174 which bursts when the pressure in the inner chamber 178 of the canister 102' exceeds the pressure in the pressure space 144.

FIG. 5B shows the activation of the product dispensing assembly 100'" by inserting the product hose 126 into the plug 162 thereby piercing the pierceable membrane 164 and providing fluid communication with the product space 142. When the user initiates product dispensing by operating the tapping handle 128, the pressure in the pressure space 144 will be reduced and the burst membrane 174 will rupture, providing gaseous communication with the inner volume 178 for allowing the pressure in the pressure space 144 to reassume its initial value.

Figure 6B:
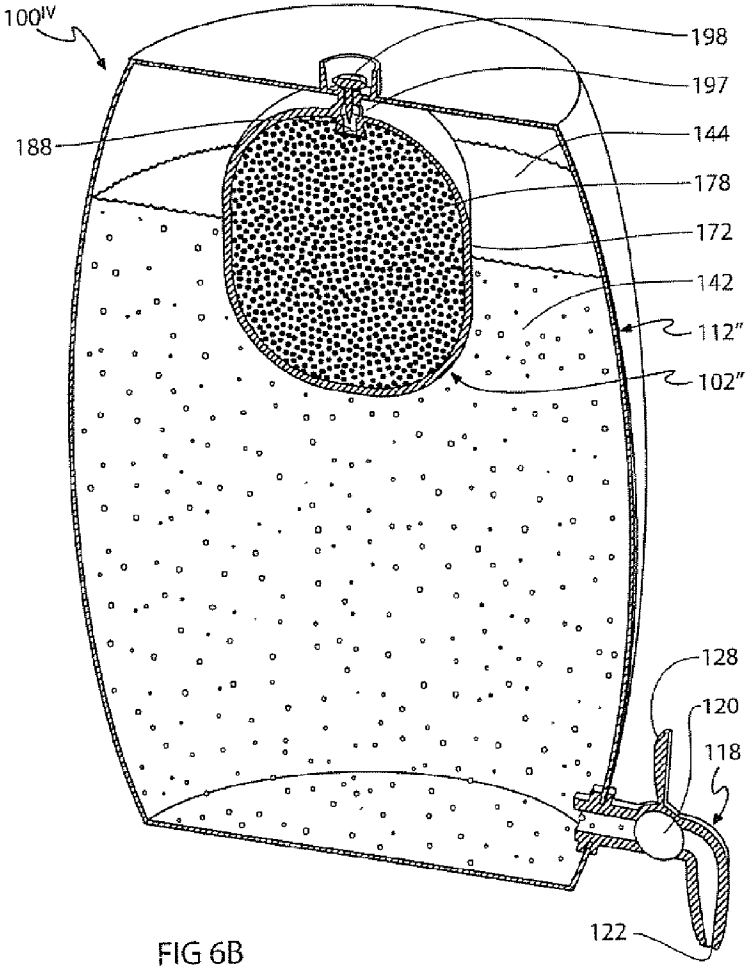
FIGS. 6A and 6B illustrate an alternative embodiment of the product dispenser assembly where the tapping hose is omitted.
Figure 6A:
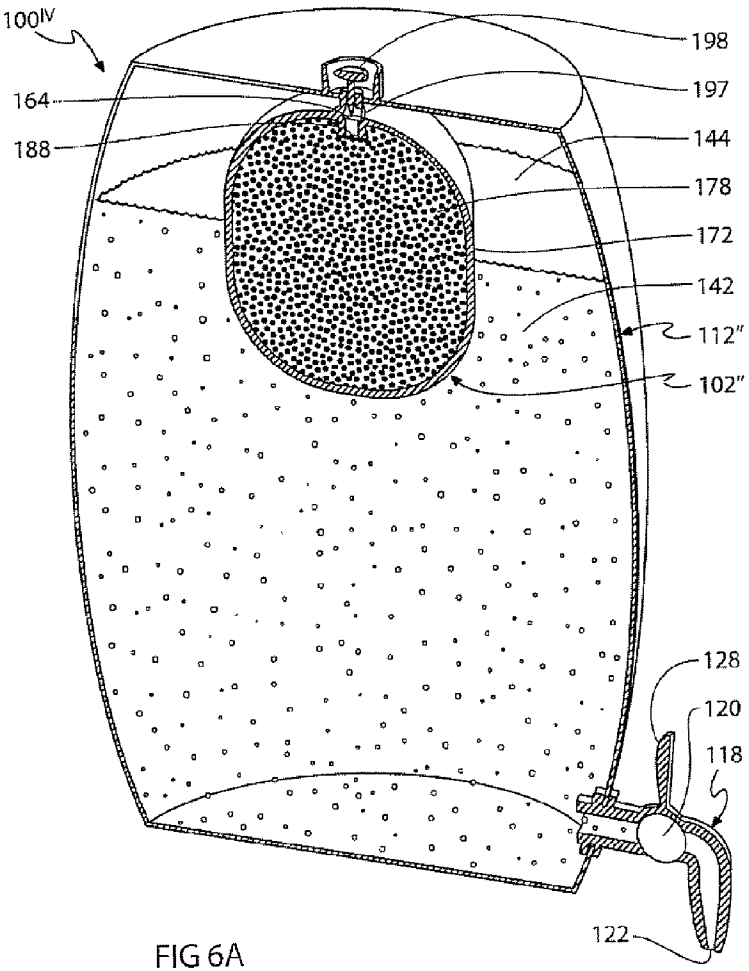

FIG. 6A shows yet an alternative embodiment of a product dispensing assembly $\mathbf{100}^{IV}$ according to the present invention. The product dispensing assembly $\mathbf{100}^{IV}$ comprises a product container 112" in the shape of a beverage barrel and includes a product space 142 and a pressure space 144. The product container 112" has a dispensing device 118 which is mounted at the lower portion of the product container 112". The dispensing device 118 includes a tapping valve 120 which is operated by a tapping handle 128. The dispensing device 118 communicates to the lower portion of the product space 142. When the product container 112" is oriented in an upright position, the dispensing device 118 will be communicating with the product space 142 until the product space 142 is essentially depleted, and thus no product hose is needed. By operating the tapping handle 128, the tapping valve 120 will open and product will dispense through the product outlet 122.

The product container 112" further comprises a canister 102" mounted inside the product container 112" at the top and communicating with the pressure space 144. The canister 102" comprises an inner chamber 178 which is filled with activated carbon. The canister 102" further comprises a hydrophobic membrane 188 providing gaseous communication between the inner chamber 178 and the pressure space 144 via an aperture 197. The hydrophobic membrane 188 is initially sealed by a pierceable membrane 164. The product container 112" further comprises a piercing element 198 which may be used to activate the product dispenser assembly $\mathbf{100}^{IV}$.

FIG. 6B shows the product dispensing assembly $\mathbf{10}^{IV}$ when activated by pressing the piercing element 198 inwardly. When the piercing element 198 is pressed, the pierecable membrane 164 is ruptured and gaseous communication is established between the inner chamber 178 and the pressure space 144. When fluid product is being dispensed and the driving pressure is reduced in the pressure space 144, $CO_2$ is being released from the inner chamber to re-pressurise the pressure space 144, thus maintaining the driving pressure. The canister 102" also releases $CO_2$ to regulate driving pressure reduction due to temperature reduction and leakage, as well as driving pressure increase due to temperature increase.

Figure 7:
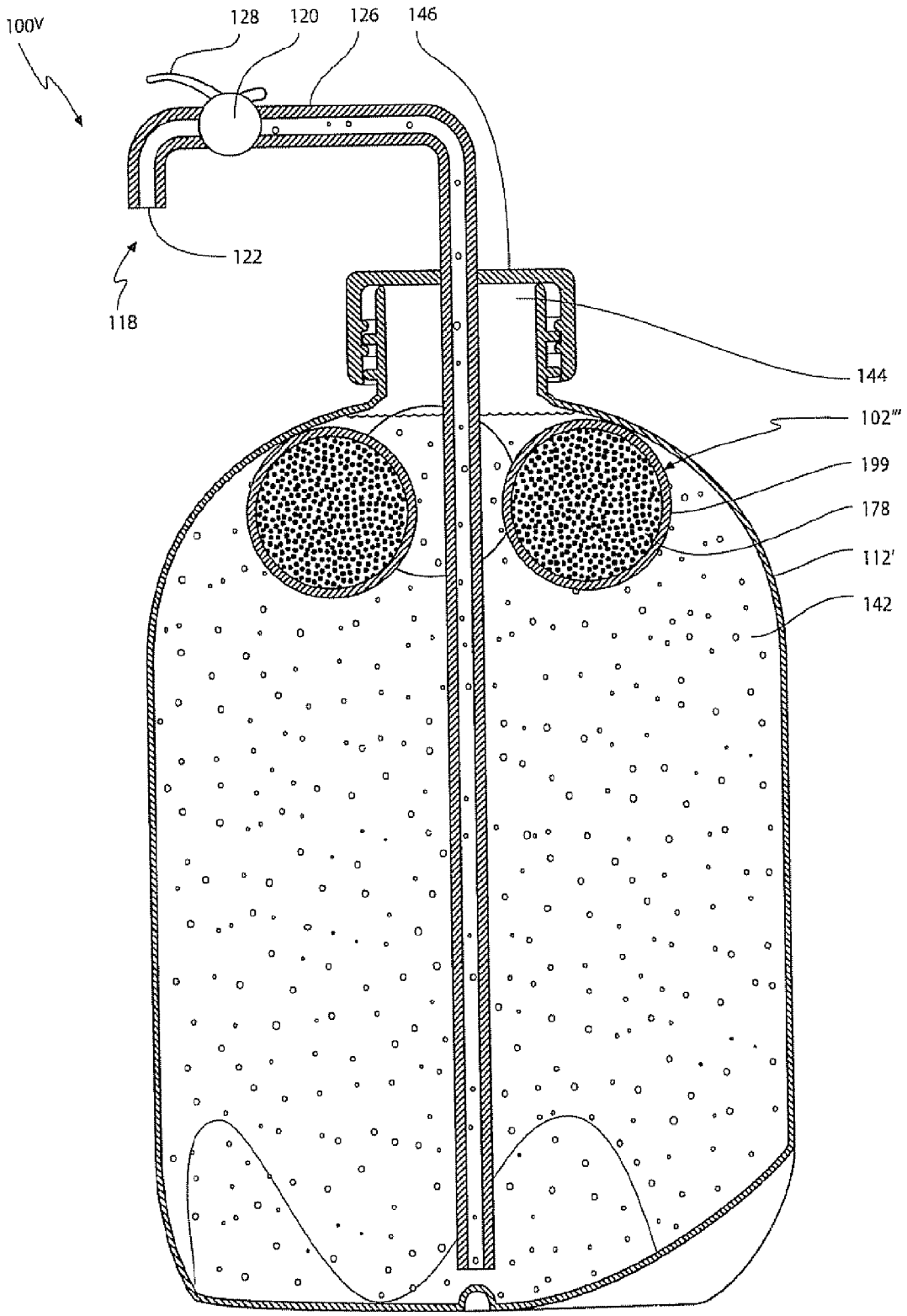
FIG. 7 is an alternative embodiment of the product dispenser assembly where the outer wall of the canister is made entirely of hydrophobic material.

FIG. 7 shows yet an alternative embodiment of a product dispensing assembly $\mathbf{100}^{V}$ according to the present invention. The present product container 112' resembles the product container described in connection with FIGS. 3A and 3B; however it includes a canister 102" having a hydrophobic wall 199. The purpose of the hydrophobic wall 199 is to eliminate the use of a hydrophobic membrane by making the complete outer wall of the canister hydrophobic, liquid impermeable but gas permeable for keeping the adsorbing material dry. The canister 102'" should be made having a specific density smaller than the product for at least partially floating at the product surface. The portion of the hydrophobic wall remaining above the product surface will communicate with the pressure space and the adsorbing material in the inner chamber 178 of the canister 102''' may release $CO_2$ to pressure space 144 as well as adsorb $CO_2$ from the pressure space 144. The portion of the hydrophobic wall 199 being submerged below the surface of the product will act as a seal and prevent any product from entering the inner chamber 178. The benefit of the present embodiment is the very simple design of the canister 102'''.

Figure 8:
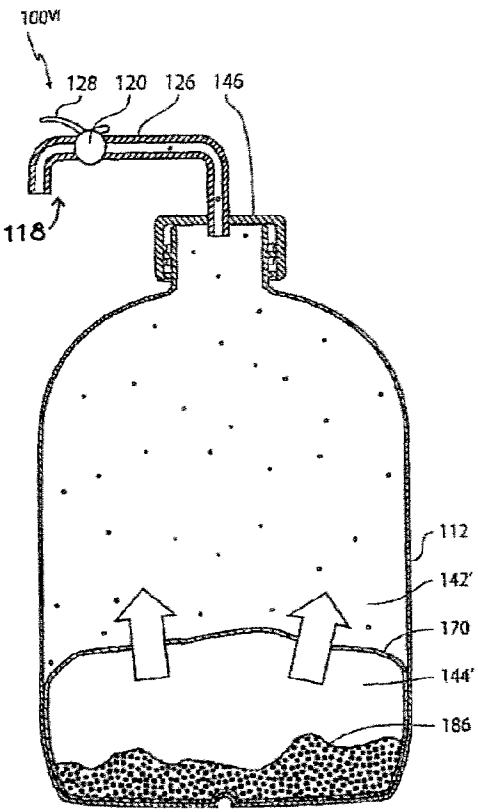
FIG. 8 is a further embodiment of the product dispenser assembly where the adsorption material is stores in a flexible bag.

FIG. 8 shows yet an alternative embodiment of a product dispensing assembly $10^{VI}$ according to the present invention. The present product container 112' resembles the product container described in connection with FIG. 3, however the canister is being omitted and the adsorption material 186 is being contained within a flexible bag 170 at the bottom of the product container 112. The product container 112' defines a pressure space 144' within the flexible bag 170 containing the adsorption material 186 and a product space 142'. The pressure space 144' and the product space 142' are separated by the flexible bag 170, which is made of flexible and/or elastic material. In the present embodiment the flexible bag 170 encapsulates the pressure space 144' and separates the pressure space 144' from the inner space of the container 112'. The product hose 126 is attached to the base part 146 for fluid communication with the product space 142', however the product hose 126 does not include any ascending pipe extending into the product space 142'. It should be noted that the present embodiment lacks a pressure space in form of a head space, since the pressure space 144' is separated from the product space 142' by the flexible bag 170. The pressure space 144' will subject the product space 142' to a driving pressure. When fluid product is being dispensed from the product space 142' by operating the tapping handle 128, the pressure in the pressure space 144' will cause the flexible bag 170 to expand and the pressure space 144' will thus substitute the product space 142'. The present embodiment has the advantage of preventing direct fluid contact between the propellant gas ($CO_2$) and the fluid product. The propellant gas cannot escape from the pressure space 144 since the propellant gas ($CO_2$) is kept separated from the dispensing device 118, thereby dispensation of fluid product is allowed independently of the orientation of the product container 112.

Figure 9:
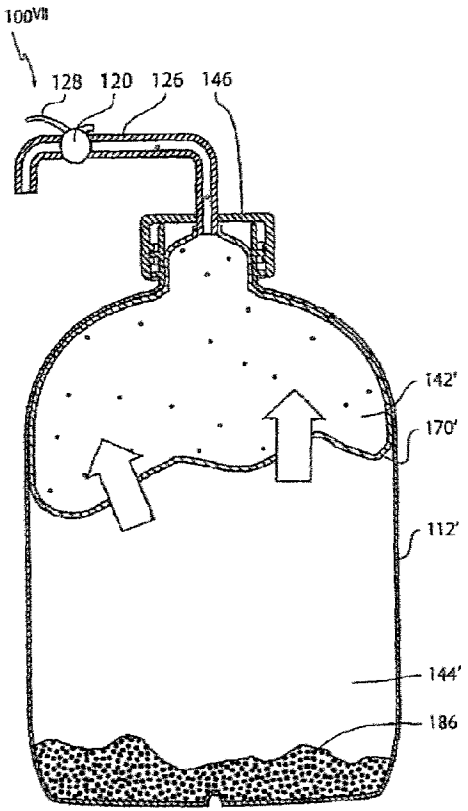
FIG. 9 is a further embodiment of the product dispenser assembly where the fluid product is stored in a flexible bag.

FIG. 9 shows an alternative embodiment of a product dispensing assembly $10^{VII}$ according to the present invention. The present product container 112' resembles the product container described in connection with FIG. 8, however instead of encapsulating the adsorption material and the pressure space 144 by the flexible bag 180, the adsorption material 186 is stored at the bottom of the product container 112' and the product space 142' containing the fluid product is encapsulated within the flexible bag 170'. The flexible bag 170' is connected to the dispensing device 118 via the product hose 126 for dispensing of the fluid product contained in the product space 142'. When fluid product is being dispensed, the flexible bag 170' contracts as the product space 142' is substituted by the pressure space 144'.

Figure 10:
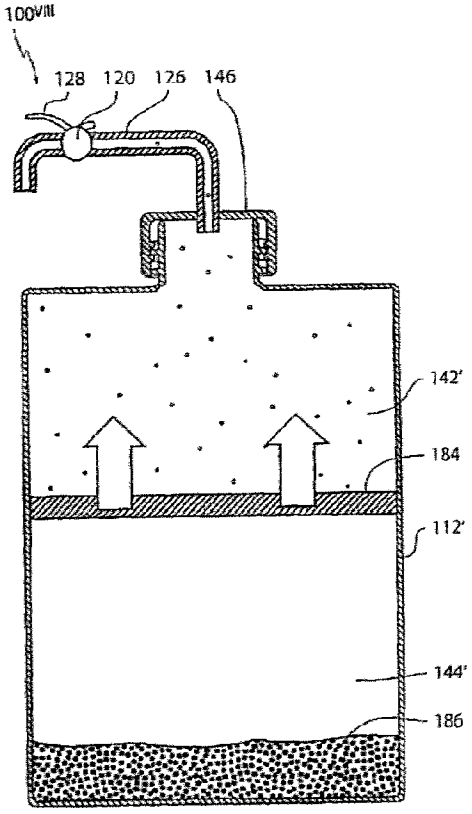
FIG. 10 is a further embodiment of the product dispenser assembly where the pressure space and the product space are separated by a movable wall.

FIG. 10 shows an alternative embodiment of a product dispensing assembly $10^{VIII}$ according to the present invention. The present embodiment features a substantially cylindrical product container 112' including a product space 142' at the lower portion of the product container 112' and a pressure space 144' at the upper portion of the product container 112'. The pressure space 144' and the product space 142" are separated by a moving wall 184. The pressure space 144' includes adsorption material 178 being stored at the bottom of the container 112'. As the fluid product is being dispensed, the pressure space 144' substitutes the product space 142' and the moving wall 184 acting as a piston translates upwardly along the inner surface of the product container 112' towards the dispensing device 118 due to the driving pressure in the pressure space 144'.

Although the present invention has been described above with reference to specific embodiments of the product dispenser assembly, it is of course contemplated that numerous modifications can be deduced by a person having ordinary skill in the art and modifications readily perceivable by a person having ordinary skill in the art is consequently to be construed as part of the present invention as defined in the appending claims.

| List of parts with reference to the figures: |
|---|
| 100. Product dispenser assembly |
| 102. Canister |
| 104. Cylinder |
| 106. Pressure gauge |
| 108. Tubing |
| 110. Valve |
| 111. Pressure inlet |
| 112. Product container |
| 113. Pressure lid |
| 114. Dispensing faucet |
| 116. Laptop computer |
| 118. Dispensing device |
| 120. Tapping valve |
| 122. Product outlet |
| 126. Product hose |
| 128. Tapping handle |
| 132. Opening |
| 142. Product space |
| 144. Pressure space |
| 146. Base part |
| 162. Plug |
| 164. Pierceable membrane |
| 170. Flexible bag |
| 172. Outer wall |
| 174. Burst membrane |
| 176. Inner wall |
| 178. Inner chamber |
| 180. Activator |
| 182. Nozzle |
| 184. Moving wall |
| 186. Activated carbon |
| 188. Hydrophobic membrane |
| 190. Pressure chamber |
| 197. Aperture |
| 198. Piercing element |
| 199. Hydrophobic wall |

Non-Exhaustive List of Fluid Products:

carbonated beverages (beer, cider, sparkling wine, mineral water, tonic, cola, soda), non-carbonated beverages (water, milk, juice, wine, liquor, coffee, tea, cacao), foodstuffs (soup, ketchup, tartar sauce, mayonnaise, mustard, whipped cream), perfumes: (eau de parfum, eau de toilette, eau de cologne, aftershave), oils (vegetable oil, petrochemical oil),pharmaceuticals, soaps, paints, detergents, gels (hair gels), pastes (toothpastes), body lotions, foams (shaving foams), aerosols (hairsprays, insect repellent, deodorant), fire-extinguishing agents (foam, powder)

The invention claimed is:

1. A method for storing a carbonated beverage in a self-regulating and constant pressure maintaining product dispenser assembly including a product container that includes a bottom and an open top, wherein an inner space is defined within the container between the bottom and the top, the method comprising the following steps:

providing an amount of an adsorption material maintained in a dry environment within the inner space, the adsorption material having adsorbed a specific amount of a propellant gas;

placing a flexible bag on the bottom of the container within the inner space of the container, the flexible bag defining a pressure space within the flexible bag and a product space configured to contain the carbonated beverage within substantially all of the inner space between the pressure space and the top of the container, the pressure space being exposed to the adsorption material;

filling the product space with the carbonated beverage;

attaching a dispensing tap to the open top of the container so as to be in fluid communication with the product space; and filling the pressure space with the propellant gas to an initial pressure of 0.1-3.0 bar above atmospheric pressure when subjected to a temperature in a temperature range of 0° C.-90° C., wherein the specific amount of the propellant gas adsorbed by the adsorption material is sufficient for allowing the flexible bag to expand, thereby increasing the volume of the pressure space so as to substitute at least some of the product space with the increasing volume of the pressure space when the carbonated beverage having a temperature in the temperature range is being dispensed from the product space by flowing through the dispensing tap, while substantially maintaining the initial pressure in the pressure space during a complete substitution of the product space by the pressure space, the amount of the adsorption material being inherently capable of substantially maintaining the initial pressure in the pressure space by:

releasing the adsorbed propellant gas into the pressure space when the pressure in the pressure space is decreased below the initial pressure due to a temperature drop in the pressure space; and re-adsorbing the propellant gas from the pressure space when the pressure in the pressure space is increased above the initial pressure due to a temperature increase in the pressure space.

2. The method of claim 1, wherein the initial pressure is not more than 2 bar above atmospheric pressure.

3. The method of claim 1, wherein the pressure space, after the complete substitution of the product space by the pressure space, has a pressure above atmospheric pressure of at least 60% of the initial pressure.

4. The method of claim 1, wherein the product space initially occupies at least 70% of the inner space.

5. The method of claim 1, wherein the adsorption material inherently adsorbs the propellant gas when the container is heated to a temperature above the temperature range.

6. The method of claim 1, wherein the container and the dispensing device are made of a material selected from the group consisting of disposable polymeric materials and combustible polymeric materials.

7. The method of claim 1, wherein the carbonated beverage in the product space has an initial mass, and wherein the amount of the adsorption material has a mass approximately 1%-10% of the initial mass of the carbonated beverage in the product space.

8. The method of claim 1, wherein the adsorption material comprises activated carbon.

9. The method of claim 1, wherein the carbonated beverage in the product space has a defined volume at atmospheric pressure, and wherein the amount of the propellant gas initially adsorbed by the adsorption material has a volume equal to 1-3 times the volume of the carbonated beverage in the product space at atmospheric pressure.

10. The method of claim 1, wherein the propellant gas is selected from the group consisting of one or more of $CO_2$, $N_2$, He, Ne, Ar, propane, butane, isobutene, dimethylether, methylethyl ether, and hydrofluoroalkanes.

* * * * *

UNITED STATES PATENT AND TRADEMARK OFFICE

CERTIFICATE OF CORRECTION

PATENT NO. : 9,114,971 B2
APPLICATION NO. : 13/264674
DATED : August 25, 2015
INVENTOR(S) : Jan Norager Rasmussen et al.

It is certified that error appears in the above-identified patent and that said Letters Patent is hereby corrected as shown below:

In The Specification

In column 6, line 26, delete “absorbing” and insert -- adsorbing --, therefor.

In column 16, line 54, delete “102.” and insert -- 102'. --, therefor.

In column 18, line 62, delete “102'''” and insert -- 102''' --, therefor.

Signed and Sealed this
Ninth Day of February, 2016

Michelle K. Lee

Michelle K. Lee
*Director of the United States Patent and Trademark Office*